US012084800B2

(12) United States Patent
Wang

(10) Patent No.: US 12,084,800 B2
(45) Date of Patent: Sep. 10, 2024

(54) FLIP-OVER ASSEMBLY FOR AUTOMATIC HAT-MAKING PRODUCTION LINE EQUIPMENT

(71) Applicant: QINGDAO QIANFENG CAPART INT'L CORP, Qingdao (CN)

(72) Inventor: Aimei Wang, Qingdao (CN)

(73) Assignee: QINGDAO QIANFENG CAPART INT'L CORP, Qingdao (CN)

( * ) Notice: Subject to any disclaimer, the term of this patent is extended or adjusted under 35 U.S.C. 154(b) by 38 days.

(21) Appl. No.: 18/009,974

(22) PCT Filed: Mar. 23, 2022

(86) PCT No.: PCT/CN2022/082509

§ 371 (c)(1),
(2) Date: Dec. 12, 2022

(87) PCT Pub. No.: WO2022/227951

PCT Pub. Date: Nov. 3, 2022

(65) Prior Publication Data

US 2023/0304204 A1 Sep. 28, 2023

(30) Foreign Application Priority Data

Apr. 28, 2021 (CN) ..... 202110464385.7

(51) Int. Cl.
*D05B 35/00* (2006.01)

(52) U.S. Cl.
CPC ..... *D05B 35/00* (2013.01)

(58) Field of Classification Search
CPC ..... H01L 21/68; F16M 11/10; F16M 11/04; F16M 11/046; D05B 23/002; D05B 35/00;

(Continued)

(56) References Cited

U.S. PATENT DOCUMENTS 3,917,249 A * 11/1975 Constantine ..... B23Q 1/5443 269/58
5,456,434 A * 10/1995 Lomauro ..... F16M 11/2014 269/71

(Continued)

FOREIGN PATENT DOCUMENTS

CN 103485083 A 1/2014
CN 205636064 U 10/2016

(Continued)

*Primary Examiner* — Gregory W Adams

(74) *Attorney, Agent, or Firm* — Bayramoglu Law Offices LLC

(57) ABSTRACT

A flip-over assembly for automatic hat-making production line equipment includes an installation seat, a flip-over component, two groups of driving components, a translation component, and an angle adjustment component. The flip-over component is correspondingly installed at a top end of the installation seat. The two groups of driving components are matchingly installed on both side walls of the installation seat. Output ends of the driving components are in a transmission connection with the flip-over component. The angle adjustment component is installed on a lower surface of the installation seat. The translation component is matchingly installed on a lower surface of the angle adjustment component. The flip-over assembly can collect cloth using a left side plate and a right side plate, and can clamp and open the cloth and perform double-needle sewing on the cloth and subsequent cloth opening, which can be controlled by the operator.

10 Claims, 6 Drawing Sheets

(58) Field of Classification Search
CPC .... D05B 41/00; B65G 7/08; B65G 2201/022; B65G 47/248; B25B 5/006; B25B 11/005; B25B 1/22; B25B 11/00; B25B 5/003; B23Q 3/18; B23Q 1/525; B21B 39/32; B21D 43/145
See application file for complete search history.

(56) References Cited

U.S. PATENT DOCUMENTS

| | | | | |
|---|---|---|---|---|
| 10,281,440 | B2 * | 5/2019 | Brandlhuber | B25B 1/18 |
| 2008/0223996 | A1 * | 9/2008 | Joanisse | F16M 13/00 248/123.11 |
| 2019/0344974 | A1 * | 11/2019 | Wicks | B65G 47/914 |
| 2019/0372514 | A1 * | 12/2019 | Almy | H02S 30/10 |

FOREIGN PATENT DOCUMENTS

| | | | |
|---|---|---|---|
| CN | 208899126 | U | 5/2019 |
| CN | 210561097 | U | 5/2020 |
| CN | 113235233 | A | 8/2021 |
| JP | H0360695 | A | 3/1991 |
| JP | H10273871 | A | 10/1998 |
| WO | 2008133603 | A1 | 11/2008 |

* cited by examiner

FLIP-OVER ASSEMBLY FOR AUTOMATIC HAT-MAKING PRODUCTION LINE EQUIPMENT

CROSS REFERENCE TO THE RELATED APPLICATIONS

This application is the national phase entry of International Application No. PCT/CN2022/082509, filed on Mar. 23, 2022, which is based upon and claims priority to Chinese Patent Application No. 202110464385.7, filed on Apr. 28, 2021, the entire contents of which are incorporated herein by reference.

TECHNICAL FIELD

The present disclosure relates to the technical field of hat-making equipment, and in particular, to a flip-over assembly for automatic hat-making production line equipment.

BACKGROUND

Hats are a kind of clothing worn on the head, most of which can cover the entire top of the head and are mainly used to protect the head. Some hats have protruding edges to prevent from the sunshine. During hat sewing, double-needle sewing is required after lamination, and the cloth subjected to lamination needs to be opened before the double-needle sewing. However, prior hat-making processing equipment has poor overall processing accuracy, and cannot perform double-needle sewing and subsequent separation and opening on the cloth, which increases secondary operation intensity of the staff. In addition, the prior processing equipment has a small working range and cannot complete cloth processing in a designated area.

The prior art has the following shortcomings. The prior hat-making processing equipment has poor overall processing accuracy, and cannot perform double-needle sewing and subsequent separation and opening on the cloth, which increases secondary operation intensity of the staff, and affects an overall processing effect. In addition, the prior processing equipment has a small working range, cannot complete cloth processing in a designated area, and cannot dynamically adjust a processing angle and a processing range according to actual use requirements.

SUMMARY

An objective of the present disclosure is to provide a flip-over assembly for automatic hat-making production line equipment, so as to solve problems in the above background art.

To achieve the above objective, the present disclosure provides the following technical solutions. A flip-over assembly for automatic hat-making production line equipment includes an installation seat, a flip-over component, two groups of driving components, a translation component, and an angle adjustment component. The flip-over component is correspondingly installed at a top end of the installation seat. The two groups of driving components are matchingly installed on both side walls of the installation seat. Output ends of the driving components are in a transmission connection with the flip-over component. The angle adjustment component is installed on a lower surface of the installation seat. The translation component is matchingly installed on a lower surface of the angle adjustment component.

Preferably, the installation seat may have a rectangular structure as a whole, and the installation seat may be pressed with steel.

Preferably, the installation seat may be provided with a sliding rail on each of both side walls, and the sliding rail may be arranged corresponding to each of the driving components.

Preferably, the flip-over component may include a rotating shaft, a first supporting member, a second supporting member, a left side plate, and a right side plate. The rotating shaft may be installed at a center of the top end of the installation seat through a bracket. The first supporting member may be rotatably installed on one side of the rotating shaft. The second supporting member may be rotatably installed on one side of the rotating shaft. The left side plate may be correspondingly locked with and installed on the first supporting member. The right side plate may be correspondingly locked with and installed on the second supporting member. The left side plate and the right side plate may be symmetrically arranged along the rotating shaft.

Preferably, two groups of left side sucking discs may be arranged in parallel on one side of an upper surface of the left side plate. Two groups of right side sucking discs may be arranged in parallel on one side of an upper surface of the right side plate. The left side sucking discs and the right side sucking discs may be distributed in parallel.

Preferably, each of the driving components may include a positioning plate, a fixing member, a cylinder, and a connecting member. The positioning plates may be installed in parallel on both side walls of the installation seat. The positioning plate may be correspondingly engaged with a sliding rail slidably. The fixing member may be locked with and installed on one side of the positioning plate. A bottom end of the cylinder may be rotatably connected with a head end of the fixing member through a pin shaft. The connecting members may be correspondingly installed at middle parts of lower surfaces of a first supporting member and a second supporting member. An output end of the cylinder may be movably connected with the connecting member through a hinge.

Preferably, the fixing member may be locked and fixed with the positioning plate through a bolt, and the fixing member may have a concave structure as a whole.

Preferably, the translation component may include a movement chamber, a driving motor, a lead screw, a driving piece, and a moving plate. The movement chamber may be arranged beneath the installation seat. The driving motor may be installed on a side wall of the movement chamber through a bracket. Both ends of the lead screw may be rotatably connected with both sides of an inner wall of the movement chamber through bearings. An output end of the driving motor may be in a transmission connection with the lead screw. The driving piece may be sleeved outside the lead screw by screwing with a screw and may be slidably attached with the inner wall of the movement chamber. The moving plate may be slidably installed on an upper surface of the movement chamber and may be connected with the driving piece.

Preferably, limiting plates may be installed in parallel at bottom ends of both side walls of the movement chamber, and installation holes may penetrate the limiting plates.

Preferably, the angle adjustment component may include a fixing column, a top plate, a stepping motor, a driving gear, and a transmission gear. The fixing column may be rotatably installed on an upper surface of a moving plate. The top plate may be installed at a top end of the fixing column. The top plate may be locked and fixed with the installation seat through a bolt. The stepping motor may be installed on one side of the fixing column through a bracket. The driving gear may be installed at an output end of the stepping motor. The transmission gear may be sleeved outside the fixing column. The driving gear may be in meshing and transmission connection with the transmission gear.

Compared with the prior art, the present disclosure has the following beneficial effects:

1. According to the present disclosure, the flip-over component is arranged, such that a cloth falls on the left side plate and the right side plate after conveying, and the flip-over assembly can collect the cloth using the left side plate and the right side plate, and can clamp and open the cloth and perform double-needle sewing on the cloth and subsequent cloth opening, which can be controlled by the operator. In addition, with the assistance of the left side sucking discs and the right side sucking discs, stability of the cloth is ensured and falling is avoided.
2. According to the present disclosure, the angle adjustment component is arranged, the fixing column is used to realize connection between the movement chamber and the installation seat, and the stepping motor is electronically controlled to drive the driving gear to rotate. Since the driving gear is in meshing and transmission connection with the transmission gear, the transmission gear and the fixing column rotate, so as to realize an overall angle adjustment of the equipment, which can be dynamically regulated and used during processing, and can process the cloth of different angles synchronously and quickly.
3. According to the present disclosure, the translation component is arranged, and the operator controls the driving motor electrically to drive the lead screw to rotate. Since the driving piece is connected with the lead screw by screwing, the moving plate is driven to slide left and right on the upper surface of the movement chamber, and the installation seat is linked to perform a translation action on the upper surface of the movement chamber, which increases the overall processing range, can stably process the cloth in the designated area, and enhances the overall processing effect.

Figure 1:
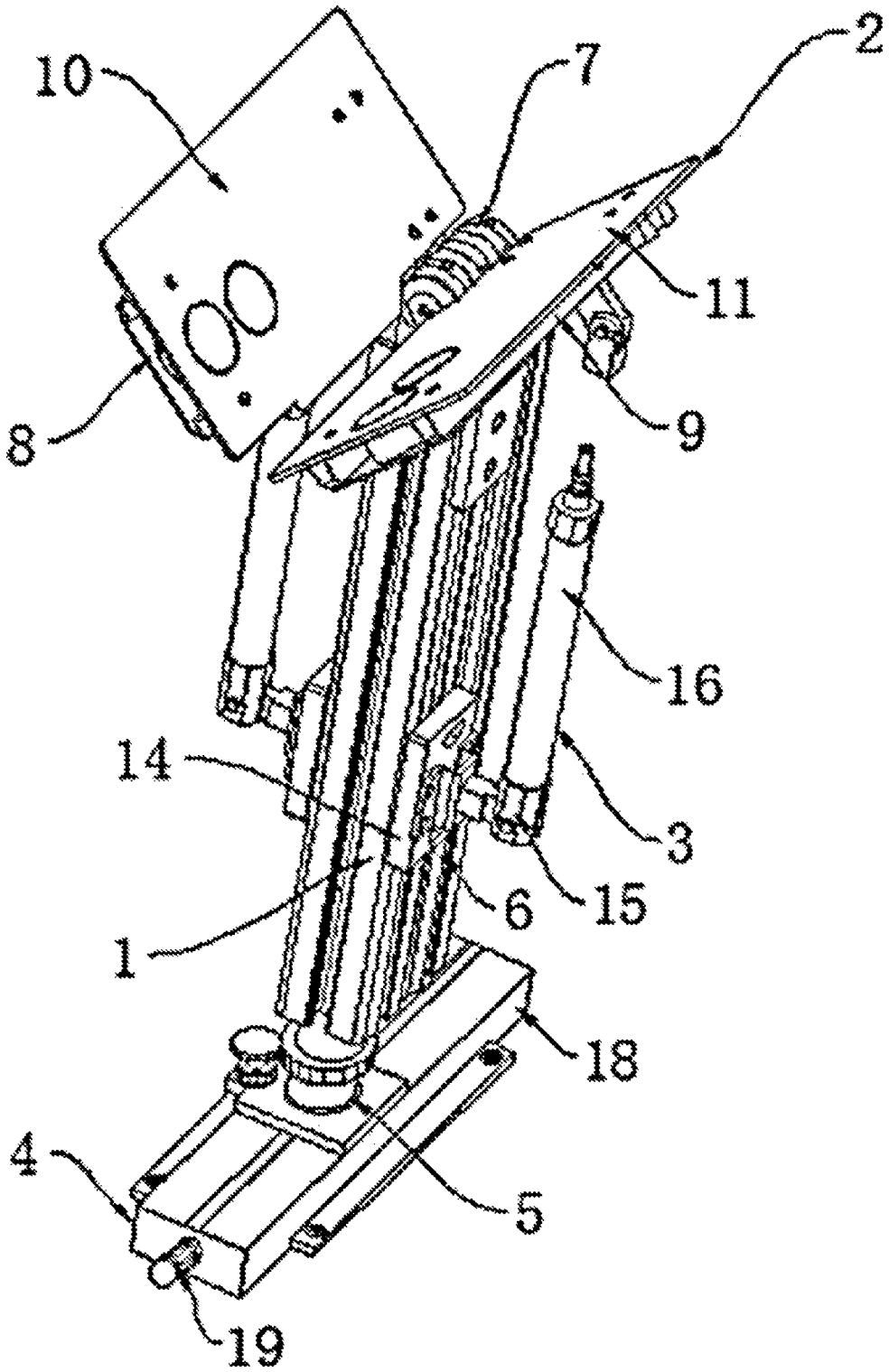
FIG. 1 is a schematic diagram illustrating an overall structure of the present disclosure.

Reference numerals: 1, an installation seat; 2, a flip-over component; 3, a driving component; 4, a translation component; 5, an angle adjustment component; 6, a sliding rail; 7, a rotating shaft; 8, a first supporting member; 9, a second supporting member; 10, a left side plate; 11, a right side plate; 12, a left side sucking disc; 13, a right side sucking disc; 14, a positioning plate; 15, a fixing member; 16, a cylinder; 17, a connecting member; 18, a movement chamber; 19, a driving motor; 20, a lead screw; 21, a driving piece; 22, a moving plate; 23, a limiting plate; 24, a fixing column; 25, a top plate; 26, a stepping motor; 27, a driving gear; and 28, a transmission gear.

DETAILED DESCRIPTION OF THE EMBODIMENTS

The technical solutions in the embodiments of the present disclosure will be described below clearly and completely with reference to the accompanying drawings in the embodiments of the present disclosure. The described embodiments are merely some rather than all of the embodiments of the present disclosure. All other embodiments obtained by those of ordinary skill in the art based on the embodiments of the present disclosure without creative efforts shall fall within the protection scope of the present disclosure.

Figure 2:
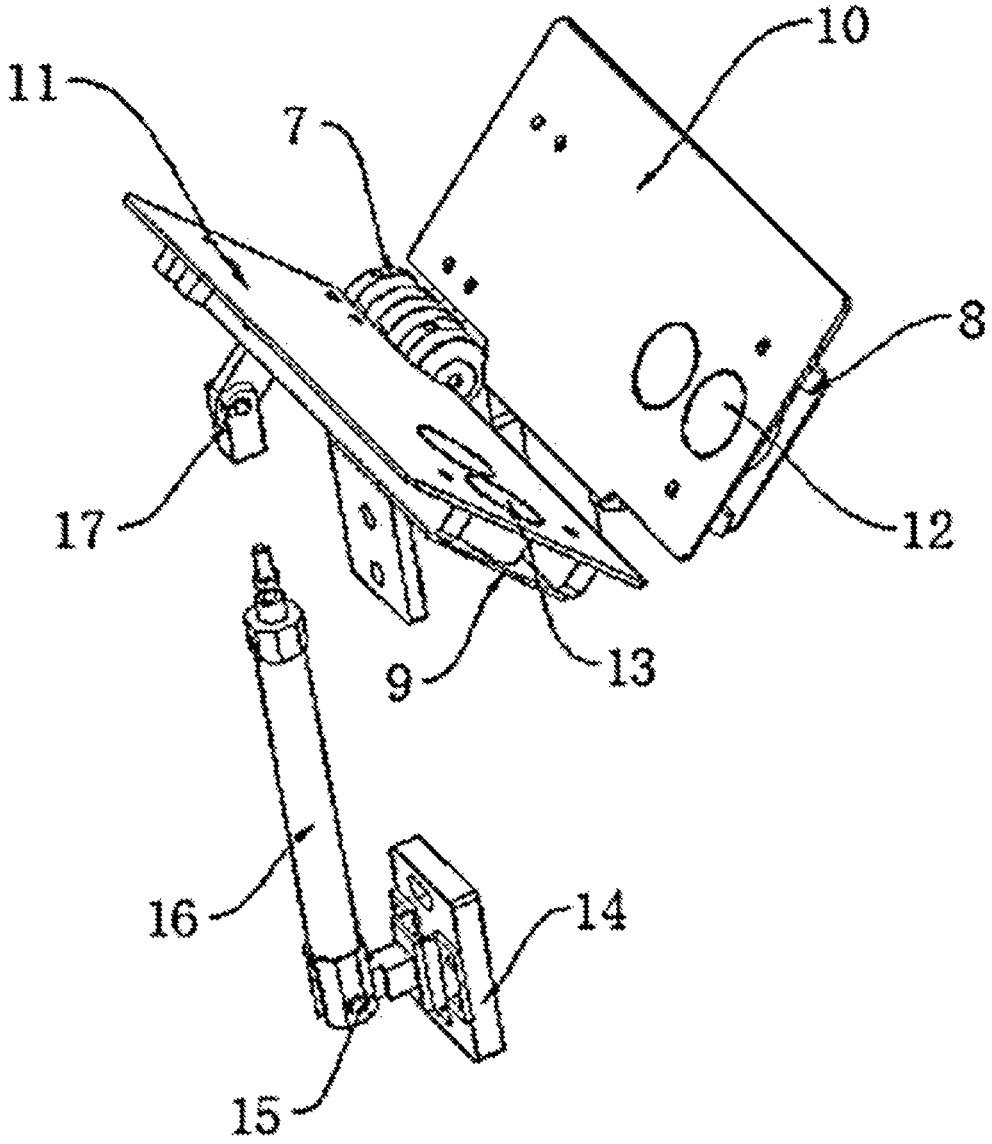
FIG. 2 is a schematic structural diagram of a driving component of the present disclosure.
Figure 3:
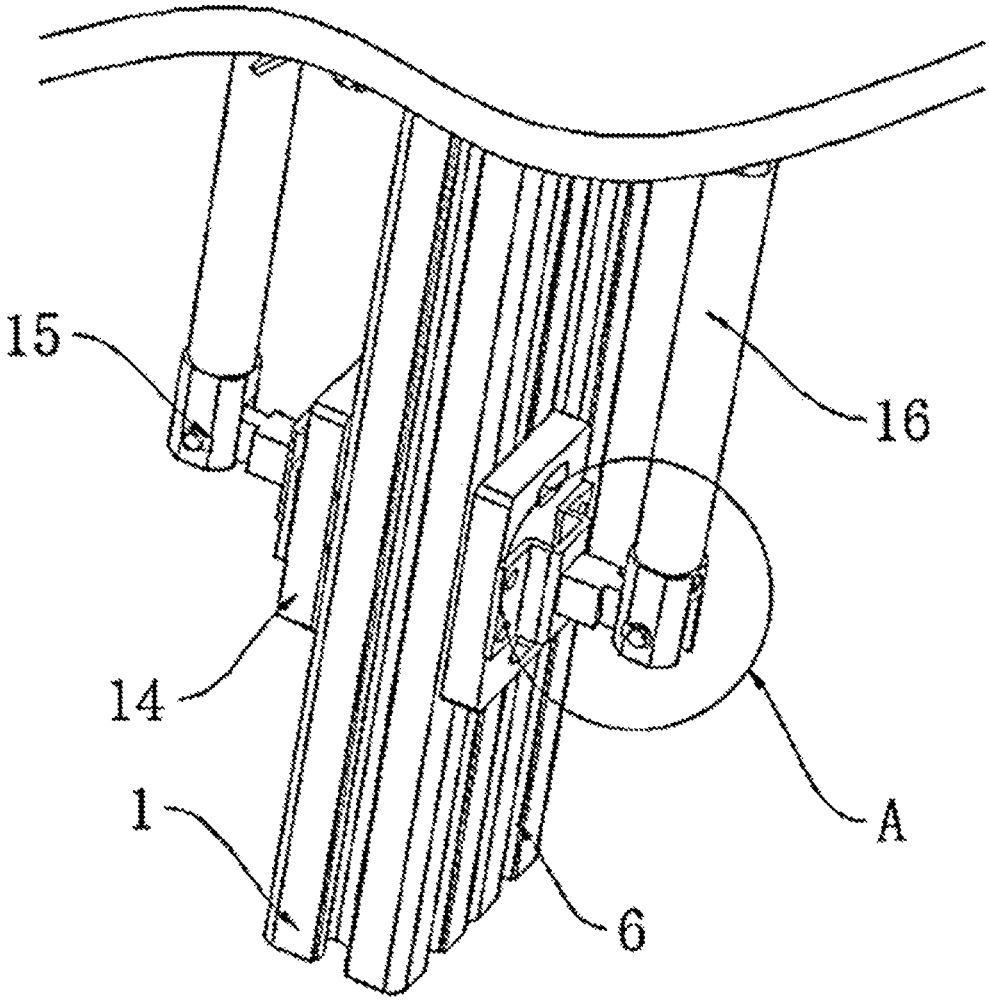
FIG. 3 is a schematic diagram of a connection between an installation seat and a cylinder of the present disclosure.
Figure 4:
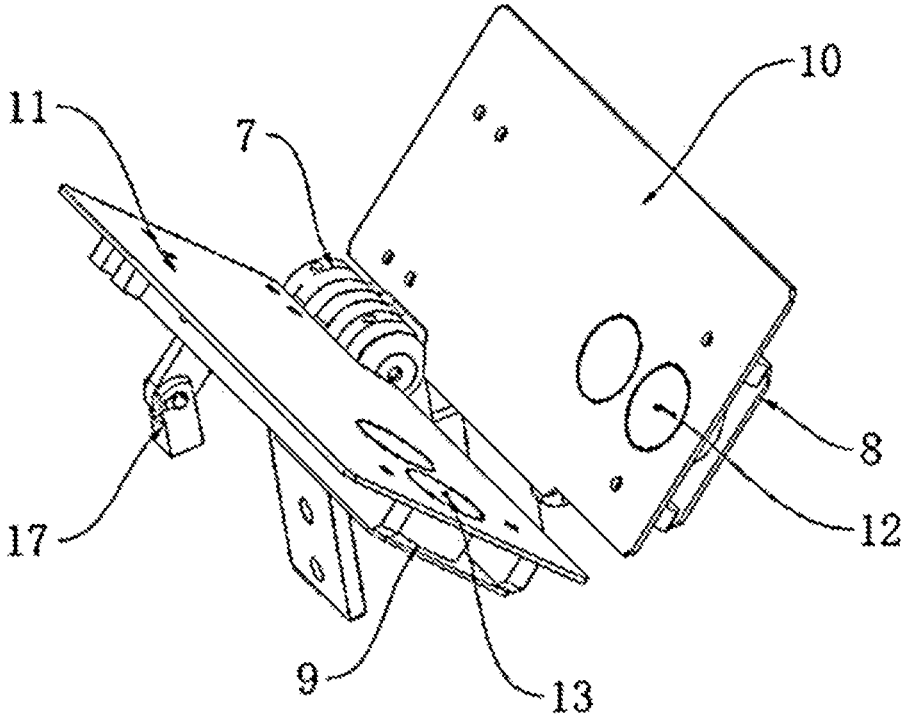
FIG. 4 is a schematic structural diagram of a flip-over component of the present disclosure.
Figure 5:
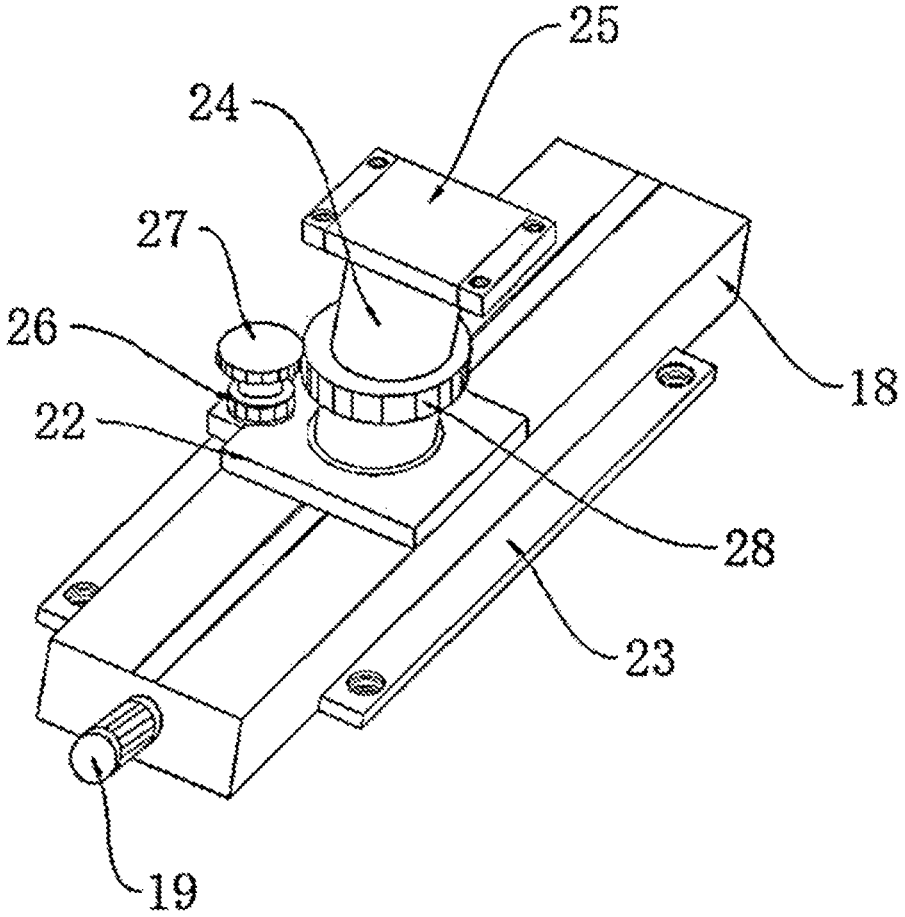
FIG. 5 is a schematic diagram of a connection between a movement chamber and a fixing column of the present disclosure.
Figure 6:
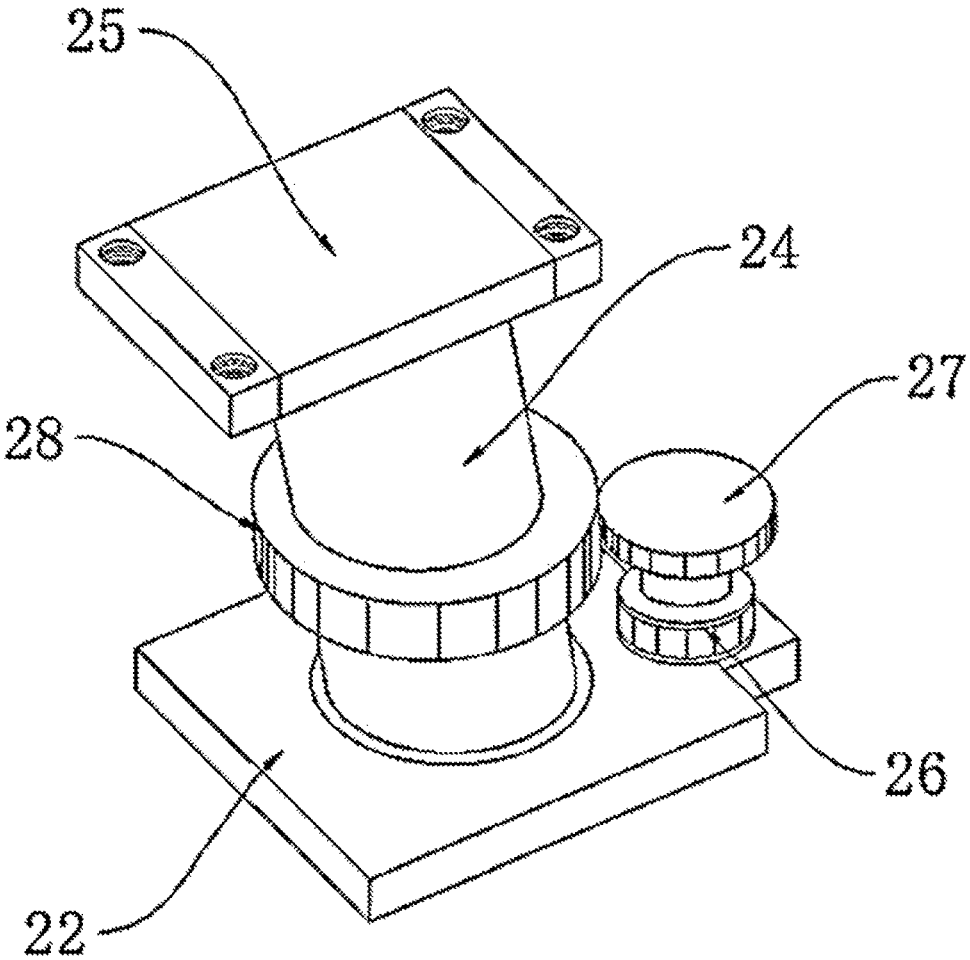
FIG. 6 is a schematic structural diagram of an angle adjustment component of the present disclosure.
Figure 7:
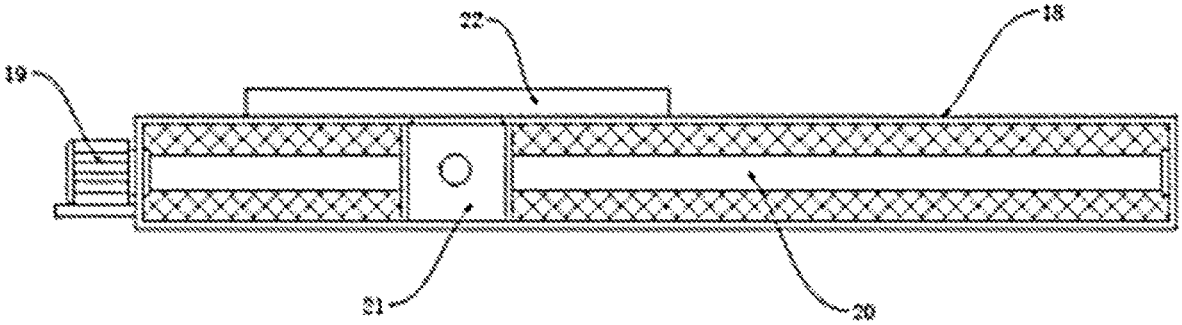
FIG. 7 is a schematic structural diagram of a translation component of the present disclosure.
Figure 8:
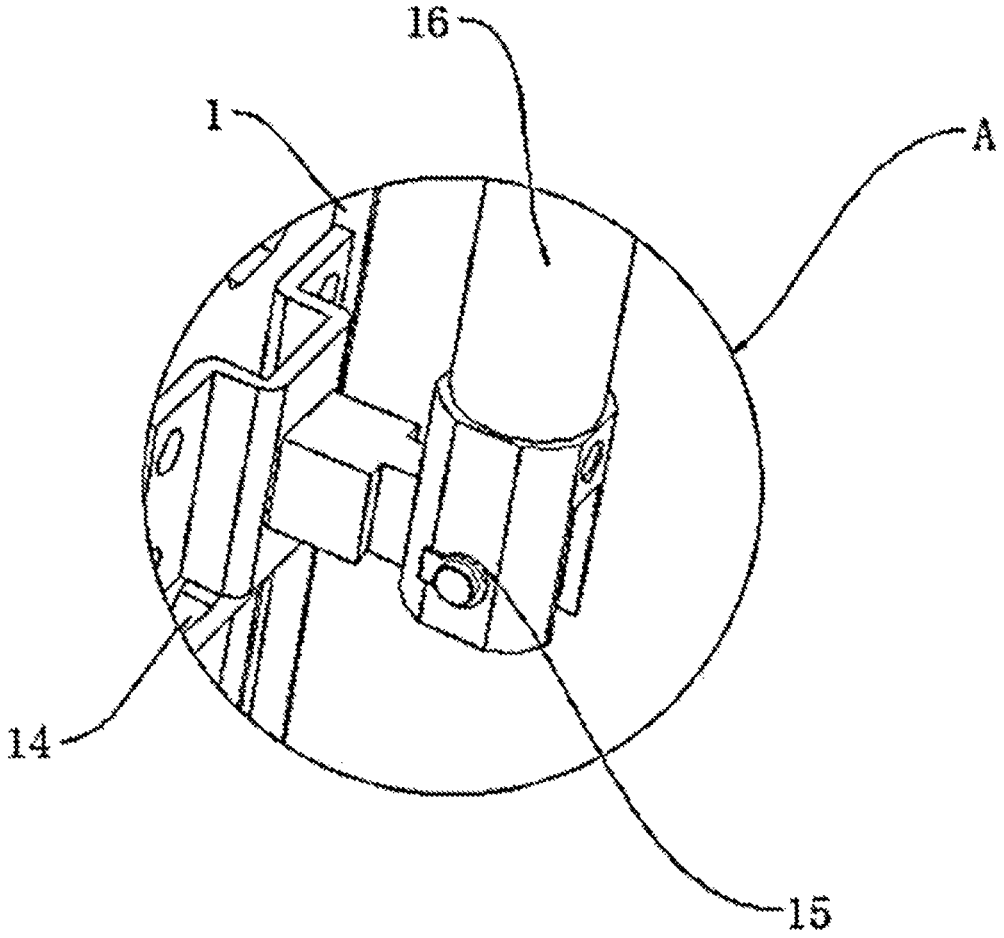
FIG. 8 is an enlarged view of A in FIG. 3 of the present disclosure.

Referring to FIG. 1 to FIG. 8, the present disclosure provides a technical solution and a flip-over assembly for automatic hat-making production line equipment includes an installation seat 1, a flip-over component 2, two groups of driving components 3, a translation component 4, and an angle adjustment component 5. The flip-over component 2 is correspondingly installed at a top end of the installation seat 1. The two groups of driving components 3 are matchingly installed on both side walls of the installation seat 1. Output ends of the driving components 3 are in a transmission connection with the flip-over component 2. The angle adjustment component 5 is installed on a lower surface of the installation seat 1. The translation component 4 is matchingly installed on a lower surface of the angle adjustment component 5.

The installation seat 1 of the present disclosure has a rectangular structure as a whole, and the installation seat 1 is pressed with steel.

The installation seat 1 of the present disclosure is provided with a sliding rail 6 on each of both side walls, and the sliding rail 6 is arranged corresponding to each of the driving components 3.

The flip-over component 2 of the present disclosure includes a rotating shaft 7, a first supporting member 8, a second supporting member 9, a left side plate 10, and a right side plate 11. The rotating shaft 7 is installed at a center of the top end of the installation seat 1 through a bracket. The first supporting member 8 is rotatably installed on one side of the rotating shaft 7. The second supporting member 9 is rotatably installed on one side of the rotating shaft 7. The left side plate 10 is correspondingly locked with and installed on the first supporting member 8. The right side plate 11 is correspondingly locked with and installed on the second supporting member 9. The left side plate 10 and the right side plate 11 are symmetrically arranged along the rotating shaft 7. The cloth falls on the left side plate 10 and the right side plate 11 after conveying. The cloth can be collected using the left side plate 10 and the right side plate 11, and the cloth can be clamped and opened. Double-needle sewing is performed on the cloth and subsequent cloth opening is performed, which can be controlled by the operator.

Two groups of left side sucking discs 12 are arranged in parallel on one side of an upper surface of the left side plate 10 of the present disclosure. Two groups of right side sucking discs 13 are arranged in parallel on one side of an upper surface of the right side plate 11. The left side sucking discs 12 and the right side sucking discs 13 are distributed in parallel. With the assistance of the left side sucking discs 12 and the right side sucking discs 13, stability of the cloth is ensured and falling is avoided.

Each of the driving components 3 of the present disclosure includes a positioning plate 14, a fixing member 15, a cylinder 16, and a connecting member 17. The positioning plates 14 are installed in parallel on both side walls of the installation seat 1. The positioning plates 14 each are correspondingly engaged with a sliding rail 6 slidably. The fixing member 15 is locked with and installed on one side of the positioning plate 14. A bottom end of the cylinder 16 is rotatably connected with a head end of the fixing member 15 through a pin shaft. The connecting members 17 are correspondingly installed at middle parts of lower surfaces of a first supporting member 8 and a second supporting member 9. An output end of the cylinder 16 is movably connected with the connecting member 17 through a hinge. The operator controls the cylinder 16 electrically, and under the transmission of the connecting member 17, the left side plate 10 and the right side plate 11 perform clamping and opening work, so as to provide a stable power source for the left side plate 10 and the right side plate 11 subsequently.

The fixing member 15 of the present disclosure is locked and fixed with the positioning plate 14 through a bolt, and the fixing member 15 has a concave structure as a whole.

The translation component 4 of the present disclosure includes a movement chamber 18, a driving motor 19, a lead screw 20, a driving piece 21, and a moving plate 22. The movement chamber 18 is arranged beneath the installation seat 1. The driving motor 19 is installed on a side wall of the movement chamber 18 through a bracket. Both ends of the lead screw 20 are rotatably connected with both sides of an inner wall of the movement chamber 18 through bearings. An output end of the driving motor 19 is in a transmission connection with the lead screw 20. The driving piece 21 is sleeved outside the lead screw 20 by screwing with a screw and is slidably attached with the inner wall of the movement chamber 18. The moving plate 22 is slidably installed on an upper surface of the movement chamber 18 and is connected with the driving piece 21. The moving plate 22 is driven to slide left and right on the upper surface of the movement chamber 18, and the installation seat 1 is linked to perform a translation action on the upper surface of the movement chamber 18, which increases the overall processing range, and can stably process the cloth in the designated area.

Limiting plates 23 are installed in parallel at bottom ends of both side walls of the movement chamber 18 of the present disclosure, and installation holes penetrate the limiting plates 23, which facilitates assembly by the operator.

The angle adjustment component 5 of the present disclosure includes a fixing column 24, a top plate 25, a stepping motor 26, a driving gear 27, and a transmission gear 28. The fixing column 24 is rotatably installed on an upper surface of a moving plate 22. The top plate 25 is installed at a top end of the fixing column 24. The top plate 25 is locked and fixed with the installation seat 1 through a bolt. The stepping motor 26 is installed on one side of the fixing column 24 through a bracket. The driving gear 27 is installed at an output end of the stepping motor 26. The transmission gear 28 is sleeved outside the fixing column 24. The driving gear 27 is in meshing and transmission connection with the transmission gear 28. Since the driving gear 27 is in meshing and transmission connection with the transmission gear 28, the transmission gear 28 and the fixing column 24 rotate, so as to realize an overall angle adjustment of the equipment, which can be dynamically regulated and used during processing, and can process the cloth of different angles synchronously and quickly.

Working principle: During use, the operator first positions and fixes the whole equipment using the limiting plate 23, which ensures efficient stable operation of subsequent processing work. The flip-over component 2 is arranged, such that the cloth falls on the left side plate 10 and the right side plate 11 after conveying. The cloth can be collected using the left side plate 10 and the right side plate 11, and the cloth can be clamped and opened. Double-needle sewing is performed on the cloth and subsequent cloth opening is performed, which can be controlled by the operator. In addition, with the assistance of the left side sucking discs 12 and the right side sucking discs 13, stability of the cloth is ensured and falling is avoided, which improves the overall processing accuracy. With the cooperation of the driving component 3, the guide of the positioning plate 14 is realized by the sliding rail 6, which is convenient for the operator to install and operate. Subsequently, the operator controls the cylinder 16 electrically, and under the transmission of the connecting member 17, the left side plate 10 and the right side plate 11 perform clamping and opening work, so as to provide a stable power source for the left side plate 10 and the right side plate 11 subsequently. The overall operation is quick and convenient for the operator to run and use. The angle adjustment component 5 is arranged, and a connection between the movement chamber 18 and the installation seat 1 is realized using the fixing column 24. The operator controls the stepping motor 26 electrically to drive the driving gear 27 to rotate, and since the driving gear 27 is in meshing and transmission connection with the transmission gear 28, the transmission gear 28 and the fixing column 24 rotate, so as to realize an overall angle adjustment of the equipment, which can be dynamically regulated and used during processing, and can process the cloth of different angles synchronously and quickly. The translation component 4 is arranged, and the operator controls the driving motor 19 electrically to drive the lead screw 20 to rotate. Since the driving piece 21 is connected with the lead screw 20 by screwing, the moving plate 22 is driven to slide left and right on the upper surface of the movement chamber 18, and the installation seat 1 is linked to perform a translation action on the upper surface of the movement chamber 18, which increases the overall processing range, can stably process the cloth in the designated area, and enhances the overall processing effect.

It should be noted that relational terms herein such as first and second are merely used to distinguish one entity or operation from another entity or operation without necessarily requiring or implying any actual such relationship or order between such entities or operations. In addition, terms "include", "comprise", or any other variations thereof are intended to cover a non-exclusive inclusion, so that a process, a method, an article, or a device including a series of elements not only includes those elements, but also includes other elements that are not explicitly listed, or also includes inherent elements of the process, the method, the article, or the device.

Although the embodiments of the present disclosure have been illustrated and described, it should be understood that those of ordinary skill in the art may make various changes, modifications, replacements, and variations to the above embodiments without departing from the principle and spirit of the present disclosure, and the scope of the present disclosure is limited by the appended claims and their legal equivalents.

What is claimed is:

1. A flip-over assembly for automatic hat-making production line equipment, comprising an installation seat, a flip-over component, two groups of driving components, a translation component, and an angle adjustment component, wherein the flip-over component is installed at a top end of the installation seat, the two groups of driving components are installed on two side walls of the installation seat, output ends of the two groups of driving components are in a first transmission connection with the flip-over component, the angle adjustment component is installed on a lower surface of the installation seat, and the translation component is installed on a lower surface of the angle adjustment component.

2. The flip-over assembly according to claim 1, wherein the installation seat has a rectangular structure, and the installation seat is pressed with a steel.

3. The flip-over assembly according to claim 1, wherein the installation seat is provided with a sliding rail on each of the two side walls, and the sliding rail is arranged corresponding to each of the two groups of driving components.

4. The flip-over assembly according to claim 1, wherein the flip-over component comprises a rotating shaft, a first supporting member, a second supporting member, a left side plate, and a right side plate, wherein the rotating shaft is installed at a center of the top end of the installation seat through a bracket, the first supporting member is rotatably installed on a first side of the rotating shaft, the second supporting member is rotatably installed on a second side of the rotating shaft, the left side plate is correspondingly locked with and installed on the first supporting member, the right side plate is correspondingly locked with and installed on the second supporting member, and the left side plate and the right side plate are symmetrically arranged along the rotating shaft.

5. The flip-over assembly according to claim 4, wherein two groups of left side sucking discs are arranged in parallel on one side of an upper surface of the left side plate, two groups of right side sucking discs are arranged in parallel on one side of an upper surface of the right side plate, and the two groups of left side sucking discs and the two groups of right side sucking discs are distributed in parallel.

6. The flip-over assembly according to claim 4, wherein each of the two groups of driving components comprises a positioning plate, a fixing member, a cylinder, and a connecting member, wherein the positioning plates are installed in parallel on the two side walls of the installation seat, the positioning plates each are correspondingly engaged with a sliding rail slidably, the fixing member is locked with and installed on one side of the positioning plate, a bottom end of the cylinder is rotatably connected with a head end of the fixing member through a pin shaft, the connecting members are correspondingly installed at a middle part of a lower surface of the first supporting member and a middle part of a lower surface of the second supporting member, and an output end of the cylinder is movably connected with the connecting member through a hinge.

7. The flip-over assembly according to claim 6, wherein the fixing member is locked and fixed with the positioning plate through a bolt, and the fixing member has a concave structure.

8. The flip-over assembly according to claim 1, wherein the translation component comprises a movement chamber, a driving motor, a lead screw, a driving piece, and a moving plate, wherein the movement chamber is arranged beneath the installation seat, the driving motor is installed on a side wall of the movement chamber through a bracket, two ends of the lead screw are rotatably connected with two sides of an inner wall of the movement chamber through bearings, an output end of the driving motor is in a second transmission connection with the lead screw, the driving piece is sleeved outside the lead screw by screwing with a screw, the driving piece is slidably attached with the inner wall of the movement chamber, the moving plate is slidably installed on an upper surface of the movement chamber, and the moving plate is connected with the driving piece.

9. The flip-over assembly according to claim 8, wherein limiting plates are installed in parallel at bottom ends of two side walls of the movement chamber, and installation holes penetrate the limiting plates.

10. The flip-over assembly according to claim 1, wherein the angle adjustment component comprises a fixing column, a top plate, a stepping motor, a driving gear, and a transmission gear, wherein the fixing column is rotatably installed on an upper surface of a moving plate, the top plate is installed at a top end of the fixing column, the top plate is locked and fixed with the installation seat through a bolt, the stepping motor is installed on one side of the fixing column through a bracket, the driving gear is installed at an output end of the stepping motor, the transmission gear is sleeved outside the fixing column, and the driving gear is in a meshing and transmission connection with the transmission gear.

* * * * *